US005306591A

United States Patent [19]

Larson et al.

[11] Patent Number: 5,306,591

[45] Date of Patent: Apr. 26, 1994

[54] LIQUID DEVELOPER COMPOSITIONS HAVING AN IMINE METAL COMPLEX

[75] Inventors: James R. Larson, Fairport; Bing R. Hsieh, Webster, both of N.Y.

[73] Assignee: Xerox Corporation, Stamford, Conn.

[21] Appl. No.: 9,202

[22] Filed: Jan. 25, 1993

[51] Int. Cl.[5] ..... G03G 9/135

[52] U.S. Cl. ..... 430/115

[58] Field of Search ..... 430/112, 115

[56] References Cited

U.S. PATENT DOCUMENTS

| | | | |
|---|---|---|---|
| 4,707,429 | 11/1987 | Trout | 430/115 |
| 4,760,009 | 7/1988 | Larson | 430/137 |
| 5,019,477 | 5/1991 | Felder | 430/115 |
| 5,028,508 | 7/1991 | Lane et al. | 430/115 |
| 5,030,535 | 7/1991 | Drappel et al. | 430/116 |
| 5,034,299 | 7/1991 | Houle et al. | 430/115 |
| 5,045,425 | 9/1991 | Swidler | 430/115 |
| 5,066,821 | 11/1991 | Houle et al. | 430/137 |
| 5,069,995 | 12/1991 | Swidler | 430/115 |

*Primary Examiner*—John Goodrow
*Attorney, Agent, or Firm*—E. O. Palazzo

[57] ABSTRACT

A liquid developer comprised of thermoplastic resin particles, a charge director, and a charge adjuvant comprised of an imine bisquinone.

30 Claims, No Drawings

LIQUID DEVELOPER COMPOSITIONS HAVING AN IMINE METAL COMPLEX

BACKGROUND OF THE INVENTION

This invention is generally directed to liquid developer compositions and, more specifically, the present invention relates to a liquid developer containing metal imine bisquinones as a charge adjuvant. More specifically, the present invention relates to liquid developers comprised of metal catechol complexes, such as imine bisquinone metal complexes like the dialkyl complexes, wherein alkyl contains, for example, from 1 to about 20 carbon atoms, like the dibutylcatechol complexes of aluminum, and zinc. The developers of the present invention can be selected for a number of known imaging systems, such as xerographic imaging and printing processes, wherein latent images are rendered visible with the liquid developer illustrated herein. The image quality, solid area coverage and resolution characteristics for developed images usually require, for example, sufficient toner particle electrophoretic mobility. The mobility for effective image development is primarily dependent on the imaging system used. The electrophoretic mobility is directly proportional to the charge on the toner particles and inversely proportional to the viscosity of the liquid developer fluid. For example, a 10 to 30 percent change in fluid viscosity caused, for instance, by a 5° to 15° C. decrease in temperature could result in a decrease in image quality, poor or unacceptable image development and undesirable background development, for example, because of a 5 percent to 23 percent decrease in electrophoretic mobility. Insufficient particle charge can also result in poor transfer of the toner to paper or other final substrates. Poor transfer, for example, can result in poor solid area coverage if insufficient toner is transferred to the final substrate and can also cause image defects such as smears and hollowed fine features. To overcome or minimize such problems, the liquid toners of the present invention were arrived at after extensive research efforts, and which toners result in, for example, sufficient particle charge to transfer and maintain their mobility within the required range of the particular imaging system employed. Other advantages associated with the present invention include increasing the desired negative charge on the developer particles and providing a charge adjuvant, or a charge additive, that is superior to other known charge adjuvants, like aluminum stearate. The aforementioned desired charge can result in improved image development and enhanced transfer.

A latent electrostatic image can be developed with toner particles dispersed in an insulating nonpolar liquid. These dispersed materials are known as liquid toners or liquid developers. A latent electrostatic image may be generated by providing a photoconductive imaging member or layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 μm (microns) average by area size as measured with the Malvern 3600E particle sizer.

Since the formation of proper images depends on the difference of the charge between the toner particles in the liquid developer and the latent electrostatic image to be developed, it is desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477, the disclosure of which is hereby totally incorporated by reference, discloses a liquid electrostatic developer comprising a nonpolar liquid, thermoplastic resin particles, and a charge director. The ionic or zwitterionic charge directors illustrated may include both negative charge directors such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) selected from the group consisting of vinyl toluene and styrene and (iv) selected from the group consisting of butadiene and acrylate. As the copolymer of polyethylene and methacrylic acid or methacrylic acid alkyl esters, NUCREL ® may be selected.

U.S. Pat. No. 5,030,535 to Drappel et al. discloses a liquid developer composition comprising a liquid vehicle, a charge control additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. Nos. 3,852,208 and 3,933,664, both to Nagashima et al., disclose colored, light-transparent photoconductive materials which are obtained by a condensation reaction of organic photoconductive substances with reactive colored components. The chemical combination of an organic photoconductive substance having at least one amino or hydroxyl group with a color development component having at least one active halogen atom generates the color developing organic photoconductive materials. Alternatively, the color developing materials can be obtained from the combination of an organic photoconductive substance having at least one active halogen atom with a color developing component having at least one amino or hydroxyl group. The color developing organic photoconductive material may be pulverized in a ball-mill, a roll-mill or an atomizer to produce a toner for use as a dry or wet developing agent, or may be used in combination with other colored substances or vehicle resins.

U.S. Pat. No. 4,524,119 to Luly et al. discloses electrophotographic dry development carriers for use with toner particles wherein the carrier core particles are coated with fluorinated carbon or a fluorinated carbon-containing resin. By varying the fluorine content of the fluorinated carbon, systematic uniform variation of the resistivity properties of the carrier is permitted. Suitable binders for use with the carrier core particles may be selected from known thermoplastics, including fluoropolymers.

U.S. Pat. No. 5,026,621 to Tsubuko et al. discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner, so that the toner is provided with both liquid-repelling and solvent-soluble properties.

U.S. Pat. No. 4,248,954 to Datta et al. discloses carrier particles for use with a dry toner composition in an electrophotographic process, which are prepared by coating the surface of the carrier particles with a perfluoro carboxylic acid in a polymeric binder. The carrier particles are capable of imparting a positive triboelectric charge to toners.

U.S. Pat. No. 4,268,598 to Leseman et al. discloses a developing powder composition prepared by blending a fluoroaliphatic sulfonamido surface active agent with a desired formulation of toner powder particles. These toners are flowable, finely divided dry powder that are generally colored and are preferably conductive and magnetically attractable.

U.S. Pat. No. 4,139,483 to Williams et al. discloses a finely divided dry toner composition comprising a colorant, a thermoplastic resin, and a surface active additive which is capable of providing a desired polarity and magnitude of triboelectric charging potential to the toner composition. The surface active additives are selected from highly fluorinated materials.

U.S. Pat. No. 4,113,641 to Brana et al. discloses a dry development powder with a high charge to mass ratio comprising a carrier particle treated with a perfluoroalkyl sulfonic acid. The core of the carrier particle can be comprised of a material which will react chemically with perfluoro sulfonic acid, and is preferably a ferromagnetic material such as iron or steel.

U.S. Pat. No. 4,388,396 to Nishibayashi et al. discloses developer particles comprising pigment particles, a binder and an offset-preventing agent selected from the group consisting of aliphatic fluorocarbon compounds and fluorochlorocarbon compounds. Electrical conductivity can be imparted to the developer by causing electrically conductive fine particles to adhere to the surfaces of the particles.

U.S. Pat. No. 4,468,446 to Mikami et al. discloses a dry electrostatographic toner for a pressure fixing process which comprises encapsulated toner particles with a pressure fixable adhesive core material containing a colorant and a pressure rupturable shell enclosing the core material, wherein the outer surface of the shell is an organofluoro compound.

Moreover in U.S. Pat. No. 4,707,429 there are illustrated, for example, liquid developers with an aluminum stearate charge adjuvant. Liquid developers with charge directors are also illustrated in U.S. Pat. No. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

The disclosures of each of the patents and the copending patent applications are totally incorporated herein by reference.

SUMMARY OF THE INVENTION

It is an object of the present invention to provide a liquid developer with many of the advantages illustrated herein.

Another object of the present invention resides in the provision of a liquid developer capable of high particle charging.

It is a further object of the invention to provide a liquid developer wherein there is selected as charge adjuvants, or charge additives, certain imine bisquinone metal complexes to enhance the negative charge of the developer, and provide toners such as four different toners with similar charging characteristics.

It is still a further object of the invention to provide a liquid developer wherein developed image defects, such as smearing, loss of resolution and loss of density, are eliminated or minimized.

Also, in another object of the present invention there are provided negatively charged liquid developers with certain charge adjuvants that are in embodiments superior to, for example, aluminum stearate in that they result in higher negative toner particle charge. The superior charge can result in improved image development and transfer.

Another object of the present invention resides in the provision of liquid developers with metal catechol charge additives, such as ditertiary-alkyl, especially butyl catechol metal complexes, such as aluminum, especially Al(III) and zinc(II).

Furthermore, in another object of the present invention there are provided liquid toners that enable excellent image characteristics, and which toners enhance the negative charge of resin, such a NUCREL ® based colored toners.

These and other objects of the present invention can be accomplished in embodiments by the provision of liquid developers with certain charge adjuvants. In embodiments, the present invention is directed to liquid developers comprised of a toner resin, pigment, a charge adjuvant of an imine bisquinone metal complex, especially the complexes of aluminum(III), zinc, and the like.

Embodiments of the present invention include a liquid developer comprised of thermoplastic resin particles; a charge director; and a charge adjuvant comprised of an imine bisquinone; a liquid developer comprised of a liquid component, thermoplastic resin; an ionic or zwitterionic charge director, or directors soluble in a nonpolar liquid; a charge additive, or charge adjuvant comprised of an imine bisquinone; and a liquid electrostatographic developer, comprised of (A) a liquid having viscosity of from about 0.5 to about 20 centipoise and resistivity equal to and preferably greater than $5\times10^9$; (B) thermoplastic resin particles with an average volume particle diameter of from about 0.1 to about 30 microns; (C) a nonpolar liquid soluble ionic or zwitterionic charge director compound; and (D) a charge adjuvant comprised of an imine bisquinone.

Examples of specific charge adjuvants present in effective amounts of, for example, from about 0.1 to about 15, and preferably from about 1 to about 4 weight percent include imine bisquinone metal complexes, which can be obtained by the oxidation of a catechol in the presence of ammonia and a metal ion. The metal ion may be, for example, Ni(II), Zn(II), Co(II), Mg(II), Fe(II), Al(III), CO(III), Fe(III), Mn(IV), and the like. The catechol can be selected from the group consisting of catechols and catechol derivatives such as catechol, alkylcatechols, 3-methylcatechol, 4-chlorocatechol, tetrachlorocatechol, tetrabromocatechol, 3,5-diisopropylcatechol, 3,5-di-t-butylcatechol, 5-t-butyl-3-methylcatechol and the like. The charge adjuvant or additive of the present invention can be represented by the following formula wherein M is the metal ion and G represents functional groups such as alkyl with from 1 to about 25 carbon atoms, like methyl, ethyl, propyl, butyl, t-butyl, pentyl, hexyl, octyl, heptyl, and the like, halo, such as chloro, bromo and iodo, or mixtures thereof.

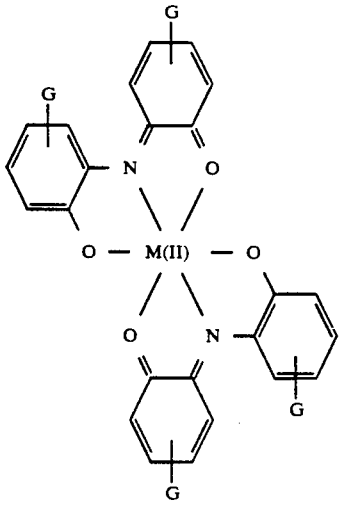

-continued

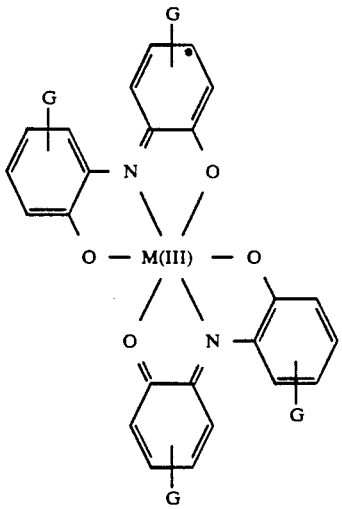

Specific examples of charge directors selected for the inks of the present invention include N-(2'-hydroxy-3',5'-di-t-butylphenyl)-4,6-di-t-butyl-o-benzoquinone imine, such as Mg(II) bis[N-(2'-hydroxy-3',5'-di-t-butylphenyl)-4,6-di-t-butyl-o-benzoquinone imine]; Cu(II) bis[N-(2'-hydroxy-3',5'-di-t-butylphenyl)-4,6-di-t-butyl-o-benzoquinone iminate]; Ni(II) bis[N-(2'-hydroxy-3',5'-di-t-butylphenyl)-4,6-di-t-butyl-o-benzoquinone iminate]; Cu(II) bis[N-(2'-hydroxy-3',5'-di-t-butylphenyl)-4,6-di-t-butyl-o-benzoquinone iminate]; Zn(II) bis[N-(2'-hydroxy-3',5'-di-t-butylphenyl)-4,6-di-t-butyl-o-benzoquinone iminate]; Zn(II) bis[N-(2'-hydroxy-3',5'-di-t-butylphenyl)-4,6-di-t-butyl-o-benzoquinone iminate]; Cd(II) bis[N-(2'-hydroxy-3',5'-di-t-butylphenyl)-4,6-di-t-butyl-o-benzoquinone iminate]; Al(III) bis[N-(2'-hydroxy-3',5'-di-t-butylphenyl)-4,6-di-t-butyl-o-benzosemiquinone iminate]; Ga(III) bis[N-(2'-hydroxy-3',5'-di-t-butylphenyl)-4,6-di-t-butyl-o-benzosemiquinone iminate]; In(III) bis[N-(2'-hydroxy-3',5'-di-t-butylphenyl)-4,6-di-t-butyl-o-benzosemiquinone iminate]; Co(III) bis[N-(2'-hydroxy-3',5'-di-t-butylphenyl)-4,6-di-t-butyl-o-benzosemiquinone iminate]; Cr(III) bis[N-(2'-hydroxy-3',5'-di-t-butylphenyl)-4,6-di-t-butyl-o-benzosemiquinone iminate]; and the like.

Examples of liquid carriers or components selected for the developers of the present invention include a liquid with an effective viscosity of, for example, from about 0.5 to about 500 centipoise, and preferably from about 1 to about 20 centipoise, and a resistivity equal to or greater than $5\times10^9$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338°

C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^9$ ohm-centimeters and a dielectric constant below 3.0 in embodiments of the present invention. Moreover, the vapor pressure at 25° C. should be less than 10 Torr in embodiments.

While the ISOPAR® series liquids can be the preferred nonpolar liquids for use as dispersants in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 90 to about 99.9 percent, and preferably from about 95 to about 99 percent by weight of the total developer dispersion, however, other effective amounts may be selected. The total solids content of the developer in embodiments is, for example, 0.1 to 10 percent by weight, preferably 0.3 to 3 percent, and more preferably, 0.5 to 2.0 percent by weight.

Typical suitable thermoplastic toner resin can be selected for the liquid developers of the present invention, in effective amounts, for example, in the range of 99 percent to 40 percent, and preferably 95 percent to 70 percent, of developer solids comprised of thermoplastic resin, pigment, charge adjuvant, and in embodiments other components that may comprise the toner. Generally, developer solids includes the thermoplastic resin, optional pigment and charge control agent. Examples of resins include ethylene vinyl acetate (EVA) copolymers, (ELVAX® resins, E. I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)-/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid (optional but preferred) and at least one alkyl ester of acrylic or methacrylic acid wherein alkyl is 1 to 20 carbon atoms, such as methyl methacrylate (50 to 90 percent)/methacrylic acid (0 to 20 percent/ethylhexyl acrylate (10 to 50 percent); and other acrylic resins including ELVACITE® acrylic resins (E. I. DuPont de Nemours and Company); or blends thereof. Preferred copolymers in embodiments include the copolymers of ethylene and an $\alpha$-$\beta$-ethylenically unsaturated acid of either acrylic acid or methacrylic acid. In a preferred embodiment, NUCREL® resins available from E. I. DuPont de Nemours and Company like NUCREL® 599, NUCREL® 699, or NUCREL® 960 are selected as the thermoplastic resin.

The liquid developer of the present invention may optionally contain, and preferably does contain in embodiments, a colorant dispersed in the resin particles. Colorants, such as pigments or dyes and mixtures thereof, are preferably present to render the latent image visible.

The colorant may be present in the toner in an effective amount of, for example, from about 0.1 to about 60 percent, and preferably from about 1 to about 30 percent by weight based on the total weight of solids contained in the developer. The amount of colorant used may vary depending on the use of the developer. Examples of pigments which may be selected include carbon blacks available from, for example, Cabot Corporation, FANAL PINK™ PV FAST BLUE™, those pigments as illustrated in U.S. Pat. No. 5,223,368, the disclosure of which is totally incorporated herein by reference; other known pigments; and the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR® YELLOW YT-858-D | Heubach | Yellow 74 |
| Hansa Yellow X | Hoechst | Yellow 75 |
| NOVAPERM® YELLOW HR | Hoechst | Yellow 83 |
| L75-2337 Yellow | Sun Chemical | Yellow 83 |
| CROMOPHTHAL® YELLOW 3G | Ciba-Geigy | Yellow 93 |
| CROMOPHTHAL® YELLOW GR | Ciba-Geigy | Yellow 95 |
| NOVAPERM® YELLOW FGL | Hoechst | Yellow 97 |
| Hansa Brilliant Yellow 10GX | Hoechst | Yellow 98 |
| LUMOGEN® LIGHT YELLOW | BASF | Yellow 110 |
| Permanent Yellow G3R-01 | Hoechst | Yellow 114 |
| CROMOPHTHAL® YELLOW 8G | Ciba-Geigy | Yellow 128 |
| IRGAZINE® YELLOW 5GT | Ciba-Geigy | Yellow 129 |
| HOSTAPERM® YELLOW H4G | Hoechst | Yellow 151 |
| HOSTAPERM® YELLOW H3G | Hoechst | Yellow 154 |
| HOSTAPERM® ORANGE GR | Hoechst | Orange 43 |
| PALIOGEN® ORANGE | BASF | Orange 51 |

-continued

| PIGMENT BRAND NAME | MANUFACTURER | COLOR |
|---|---|---|
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI77266 |
| UHLICH ® BK 8200 | Paul Uhlich | Black |

Suitable nonpolar liquid soluble ionic or zwitterionic charge director compounds which are selected in various effective amounts, such as for example from about 0.25 to about 1,500 milligrams/gram, and preferably 2.5 to 400 mg/g based on the amount of developer solids comprised of resin, pigment, and charge adjuvant, include anionic glyceride, such as EMPHOS D70-30C TM and EMPHOS F27-85 TM, two commercial products sold by Witco Corporation, New York, N.Y., which are sodium salts of phosphated mono and diglycerides with unsaturated and saturated acid substituents, respectively, lecithin, BASIC BARIUM PETRONATE ®, NEUTRAL BARIUM PETRONATE ®, CALCIUM PETRONATE ®, NEUTRAL CALCIUM PETRONATE ®, oil soluble petroleum sulfonates, Witco Corporation, New York, N.Y.; and metallic soaps such as barium, calcium, lead, and zinc stearates; cobalt, manganese, lead, and zinc linoleates, calcium and cobalt octoates, quaternary ammonium block copolymers as illustrated, for example, in U.S. Pat. No. 5,035,972, the disclosure of which is totally incorporated herein by reference, other known charge directors, and the like.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning. Toner particle mobility can be measured using the electroacoustics effect, the application of an electric field and the measurement of sound described, for example, in Oja et al. U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is for example high measured mobilities have been shown to result in improved image density, higher image resolution and superior transfer efficiency. Residual conductivity, that is the conductivity from the charge director, can be measured with a low field device as described in the Examples that follow.

To increase the toner particle charge and, accordingly, increase the mobility and transfer latitude of the toner particles, the prior art selects charge adjuvants that are added to the toner particles. For example, adjuvants, such as metallic soaps, like aluminum or magnesium stearate or octoate, fine particle size oxides, such as oxides of silica, alumina, titania, and the like, paratoluene sulfonic acid, and polyphosphoric acid, may be added. Negative charge adjuvants increase the negative charge of the toner particle, while the positive charge adjuvants increase the positive charge of the toner particles. With the invention of the present application, the adjuvants or charge additives are comprised of the catechol complexes illustrated herein, and these additives have the advantages illustrated herein over the aforementioned prior art charge additives, including specifically, improved toner charging characteristic, namely, an increase in particle charge that results in improved electrophoretic mobility for improved image development and transfer to allow superior image quality with improved solid area coverage and resolution in embodiments. The adjuvants can be added to the toner particles in an amount of from about 0.1 percent to about 15 percent of the total developer solids and preferably from about 1 percent to about 5 percent of the total weight of solids contained in the developer.

The liquid electrostatic developer of the present invention can be prepared by a variety of processes such as, for example, mixing, in a nonpolar liquid the thermoplastic resin, charging additive and optional colorant in a manner that the resulting mixture contains, for example, about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding the charge director compound to the dispersion; and diluting the dispersion.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, adjuvant and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added should be sufficient in embodiments to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, glycols, such as ethylene gylcol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778; 4,783,389, the disclosures of which are totally incorporated herein by reference.

As illustrated herein, the developers, inks or toners of the present invention can be selected for imaging and printing methods wherein, for example, a latent image is formed on a photoconductive imaging member, reference for example selenium, selenium alloys, those of U.S. Pat. No. 4,265,990, the disclosure of which is totally incorporated herein by reference, and the like; followed by development with the toner of the present invention by, for example, immersion of the imaging member in the liquid toner; transfer to a suitable substrate like paper; and fixing by heating.

Embodiments of the invention will be illustrated in the following nonlimiting Examples, it being understood that these Examples are intended to be illustrative only and that the invention is not intended to be limited to the materials, conditions, process parameters and the like recited. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to provide an ESA signal corresponding to a zeta potential of −26 mv for a 10 percent (v/v) suspension of LUDOX TM (DuPont). The system was then set up for nonaqueous measurements. The toner particle mobility can be dependent on a number of factors, including primarily particle charge and particle size. The ESA system also calculates the zeta potential which is a directly proportional to toner charge and is independent of particle size. Particle size was measured by two methods: (1) the Malvern 3600E Particle Sizer manufactured by Malvern, Southborough, Mass. uses laser diffraction light scattering of stirred samples to determine average particle sizes; and (2) Horiba CAPA-500 centrifugal automatic particle analyzer manufactured by Horiba Instruments, Inc, Irvine, Calif. Since the Malvern and Horiba instruments use different techniques to measure average particle size, the readings usually differ. The following correlation of the average size of toner particles in microns for the two instruments is:

| VALUE DETERMINED BY MALVERN 3600E PARTICLE SIZER | EXPECTED RANGE FOR HORIBA CAPA-500 |
|---|---|
| 30 | 9.9 +/− 3.4 |
| 20 | 6.4 +/− 1.9 |
| 15 | 4.6 +/− 1.3 |
| 10 | 2.8 +/− 0.8 |
| 5 | 1.0 +/− 0.5 |
| 3 | 0.2 +/− 0.6 |

This correlation can be obtained by statistical analysis of average particle sizes for 67 known liquid developer samples on both instruments. The expected range of Horiba values was determined using linear regression at a confidence level of 95 percent.

Specific embodiments of the invention will now be described in detail. These Examples are intended to be illustrative, and the invention is not limited to the materials, conditions, or process parameters set forth in these embodiments. All parts and percentages are by weight unless otherwise indicated.

CONTROL 1

27 grams of NUCREL 599®, a copolymer of ethylene and methacrylic acid with a melt index at 190° C. of 500 dg/minute as determined by ASTM D-1238, available from E. I. DuPont de Nemours & Company, Wilmington, Del., 3 grams of the cyan pigment NBD 7010 TM, available from BASF, Holland, Mich., and 170 grams of NORPAR 15®, carbon chain of 15 average, available from Exxon Corporation, were added to a Union Process O1 attritor (Union Process Company, Akron, Ohio) charged with 0.187 inch (4.76 millimeters( diameter carbon steel balls. The mixture was milled in the attritor, which was heated with running steam through the attritor jacket at 70° to 100° C. for 1 hour and cooled by running water through the attritor jacket to 15° C., and ground in the attritor for an additional 4 hours. About 170 grams of NORPAR 15® were then added and the mixture was separated by the use of a metal grate from the steel balls yielding 350 grams of 1.61 percent solids by weight. The particle size is 7.2 microns for the V (50) (the volume weighted average particle size) measured with a Malvern 3600E particle size analyzer. 0.562 gram of BASIC BARIUM PETRONATE® (Witco Chemical Corporation, New York, N.Y.) was added to the dispersion. The mobility of the toner was measured and the result is presented in Table 1.

CONTROL 2

200 grams of NUCREL 599® (a copolymer of ethylene and methacrylic acid with a melt index at 190° C. of 500, available from E. I. DuPont de Nemours & Company, Wilmington, Del.), 22.7 grams of the cyan pigment NBD 7010 TM, BASF, Holland, Mich., and 4.5 grams of aluminum stearate, one of the commercially used liquid developer charge adjuvant, WITCO 22 TM (Witco Chemical Corporation, New York, N.Y.), and 1,287 grams of NORPAR 15® (Exxon Corporation) were added to a Union Process O1 attritor (Union Process Company, Akron, Ohio) charged with 0.1857 inch (4.76 millimeters) diameter carbon steel balls. The mixture was milled in the attritor, which was heated with running steam through the attritor jacket at 60° to 85° C. for 2 hours and cooled by running water through the attritor jacket to 18° C., and ground in the attritor for an additional 6 hours. Additionally, about 170 grams of NORPAR 15® were added and the mixture resulting was separated by the use of a metal grate from the steel balls. The particle size was 7.0 microns for the V (50) (the volume weighted average particle size) measured with a Malvern 3600E particle size analyzer. The dispersion was diluted to 2 percent solids, and 343 grams of the diluted dispersion was charged to form negative particles by the addition of 0.7 gram of BASIC BARIUM PETRONATE® (Witco Chemical Corporation, New York, N.Y.). The mobility of the toner was measured and the result is presented hereinafter.

EXAMPLE I

Preparation of Zn (II) Bis[N-(2'-hydroxy-3',5'-di-t-butylphenyl)-4,6-di-t-butyl-o-benzoquinone imine]

A solution of 3,5-di-t-butylcatechol (5.24 grams, 0.0236 mol) in ethanol (280 milliliters) was prepared in a 600 milliliter beaker. This solution was added into a 1 liter three necked flask containing an aqueous solution (25 milliliters) of zinc acetate dihydrate (1.15 gram, 0.0052 mol). The resulting solution mixture was stirred with a magnetic bar. Air was bubbling directly into the solution via a glass tubing adaptor before the addition of concentrated ammonia hydroxide (20 milliliters). Stirring and air bubbling were continued for 3 hours. A green black precipitate, which was formed after the first hour, was collected by suction filtration, washed with ethanol and then air dried to provide a black powder (4.3 grams). The above product Zn (II) bis[N-(2'-hydroxy-3',5'-di-t-butylphenyl)-4,6-di-t-butyl-o-benzoquinone imine] referred to as DBC/$ZnCl_2$ was identified by NMR Spectroscopy.

EXAMPLE II

Preparation of Aluminum (III) Complex of N-(2'-hydroxy-3',5'-di-t-butylphenyl)-4,6-di-t-butyl-o-benzoquinone imine A solution of 3,5-di-t-butylcatechol (2.6 grams, 0.012 mol) in ethanol (140 milliliters) was prepared in a 400 milliliter beaker. This solution was added into a 500 milliliter three necked flask containing an aqueous solution (15 milliliters) of aluminum chloride hexahydrate (0.72 gram, 0.0030 mol). The resulting solution mixture was stirred with a magnetic bar. Air was bubbling directly into the solution via a glass tubing adaptor before the addition of concentrated ammonia hydroxide (10 milliliters). Stirring and air bubbling were continued for 3 hours. Green black preciperate was collected by suction filtration, washed with ethanol and then air dried to provide a black powder (2.2 grams). This product aluminum (III) complex of N-(2'-hydroxy-3',5'-di-t-butylphenyl)-4,6-di-t-butyl-o-benzoquinone imine, referred to as DBC/$AlCl_3$, was identified by NMR spectroscopy.

EXAMPLE III

Twenty-seven (27) grams of NUCREL 599® (a copolymer of ethylene and methacrylic acid with a melt index at 190° C. of 500, available from E. I. DuPont de Nemours & Company, Wilmington, Del.), 3 grams of the cyan pigment NBD 7010 TM (BASF, Holland, Mich.), 0.60 gram of the charge adjuvant DBC/$AlCl_3$ obtained from Example II and 170 grams of NORPAR 15® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 70° to 105° C. for 1 hour and cooled by running water through the attritor jacket to 14° C. and ground in the attritor for an additional 4 hours. Additionally, about 170 grams of NORPAR 15® were added and the mixture was separated from the steel balls yielding 350 grams of 1.31 percent solids by weight. The particle size was 6.5 microns for the V (50) (the volume weighted average particle size) measured with a Malvern 3600E particle size analyzer. The dispersion was charged by the addition of 0.457 gram of BASIC BARIUM PETRONATE® (Witco Chemical Corporation, New York, N.Y.). The mobility of the toner was measured and the result is presented hereinafter.

EXAMPLE IV

Twenty-seven (27) grams of NUCREL 599® (a copolymer of ethylene and methacrylic acid with a melt index at 190° C. of 500, available from E. I. DuPont de Nemours & Company, Wilmington, Del.), 3 grams of cyan pigment NBD 7010 (BASF, Holland, Mich.), 0.60 gram of DBC/$ZnCl_2$ (from Example I) and 170 grams of NORPAR 15 ® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 70° to 100° C. for 1 hour and cooled by running water through the attritor jacket to 15° C. and ground in the attritor for an additional 4 hours. Additionally, NORPAR 15 ® was added and the mixture was separated from the steel balls yielding 350 grams of 1.61 percent solids by weight. The particle size was 5.7 microns for the V (50) (the volume weighted average particle size) measured with a Malvern 3600E particle size analyzer. The dispersion was charged by the addition of 0.56 gram of BASIC BARIUM PETRONATE ® (Witco Chemical Corporation, New York, N.Y.). The mobility of the toner was measured and the result is presented hereinafter.

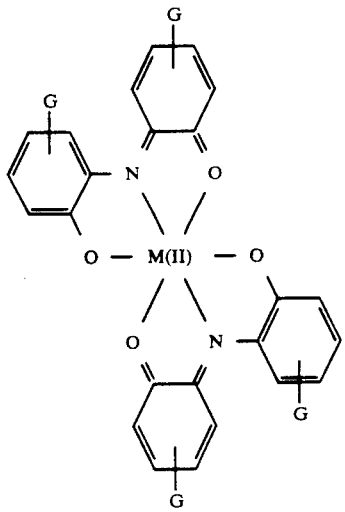

| EXAMPLE | ADJUVANT | CONDUCTIVITY (pmho/cm) | MOBILITY ($10^{-10}$ $m^2/Vs$) | ZETA POTENTIAL (mV) |
|---|---|---|---|---|
| Control 1 | None | 13 | −0.11 | −7 |
| Control 2 | Aluminum Stearate | 5 | −2.29 | −156 |
| Example III | DBC/$AlCl_3$ | 5 | −3.56 | −218 |
| Example IV | DBC/$ZnCl_2$ | 28 | −0.76 | −39 |

The mobility of $-3.56\times10^{-10}$ $m^2/Vs$ indicates a toner that will provide, for example, superior toner transfer efficiency, thereby enabling images with superior resolution, less background, minimal or no smear, for extended time periods, as compared to the liquid toner with a mobility of $-2.23\times10^{-10}$ $m^2/Vs$.

The higher mobility found in Example III compared to Controls 1 and 2, and the higher mobility of Example IV compared to Control 1 will result in improved development and transfer.

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer comprised of (A) a liquid with a viscosity of from about 0.5 to about 20 centipoise and a resistivity equal to or greater than $5\times10^9$; (B) thermoplastic resin particles with an average volume particle diameter of from about 0.1 to about 30 microns; (C) a nonpolar liquid soluble ionic or zwitterionic charge director compound; and (D) a charge adjuvant comprised of an imine bisquinone metal complex.

2. A developer in accordance with claim 1 wherein the imine bisquinone metal complex is of the following formulas wherein M is a metal ion and G represents the functional groups alkyl and halo

OR

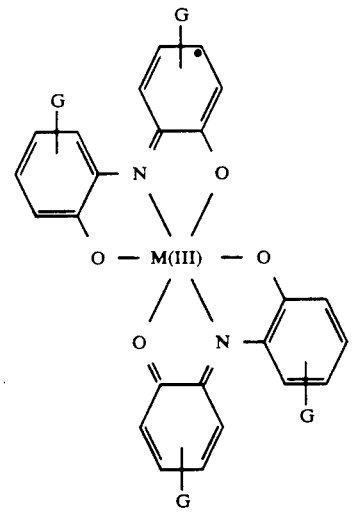

3. A developer in accordance with claim 1 wherein the imine bisquinone metal complex is of the following formulas wherein M is a metal ion selected from the group consisting of Ni (II), Zn (II), Co (II), Mg (II), Fe (II), AL (III), and Mn (IV); and G represents functional groups

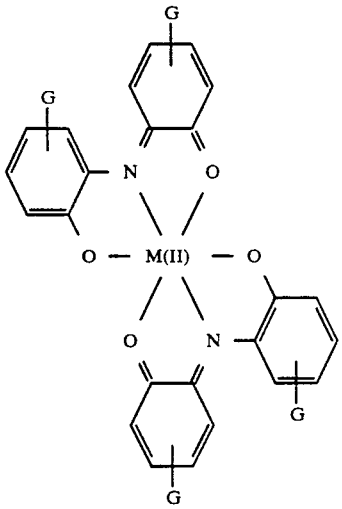

OR

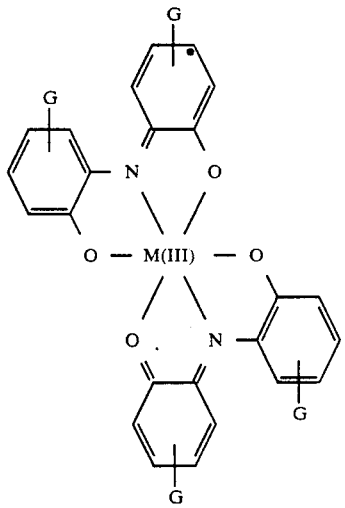

4. A developer in accordance with claim 1 wherein the imine bisquinone metal complex is selected from the group consisting of Mg (II) bis[N-(2'-hydroxy-3',5'-di-t-butylphenyl)-4,6-di-t-butyl-o-benzoquinone imine]; Cu (II) bis[N-(2'-hydroxy-3',5'-di-t-butylphenyl)-4,6-di-t-butyl-o-benzoquinone iminate]; Ni (II)bis[N-(2'-hydroxy-3',5'-di-t-butylphenyl)-4,6-di-t-butyl-o-benzoquinone iminate]; Cu (II) bis[N-(2'-hydroxy-3',5'-di-t-butylphenyl)-4,6-di-t-butyl-o-benzoquinone iminate]; Zn (II) bis[N-(2'-hydroxy-3',5'-di-t-butylphenyl)-4,6-di-t-butyl-o-benzoquinone iminate]; Zn (II) bis[N-(2'-hydroxy-3',5'-di-t-butylphenyl)-4,6-di-t-butyl-o-benzoquinone iminate]; Cd (II)bis[N-(2'-hydroxy-3',5'-di-t-butylphenyl)-4,6-di-t-butyl-o-benzoquinone iminate]; Al (III) bis[N-(2'-hydroxy-3',5'-di-t-butylphenyl)-4,6-di-t-butyl-o-benzosemiquinone iminate]; Ga (III) bis[N-(2'-hydroxy-3',5'-di-t-butylphenyl)-4,6-di-t-butyl-o-benzosemiquinone iminate]; In (III) bis[N-(2'-hydroxy-3',5'-di-t-butylphenyl)-4,6-di-t-butyl-o-benzosemiquinone iminate]; Co (III) bis[N-(2'-hydroxy-3',5'-di-t-butylphenyl)-4,6-di-t-butyl-o-benzosemiquinone iminate]; Cr (III) bis[N-(2'-hydroxy-3',5'-di-t-butylphenyl)-4,6-di-t-butyl-o-benzosemiqinone iminate] and mixtures thereof.

5. A developer in accordance with claim 2 wherein the metal is aluminum or zinc.

6. A developer in accordance with claim 1 wherein the resin is a copolymer of ethylene and an $\alpha$, $\beta$ ethylenically unsaturated acid selected from the group consisting of acrylic acid and methacrylic acid; a copolymer of ethylene acrylic or methacrylic acid, alkylester of acrylic or methacrylic acid, or a copolymer of ethylene and methacrylic acid with a melt index at 190° C. of 500.

7. A developer in accordance with claim 1 containing a colorant, pigment, or dye.

8. A developer in accordance with claim 7 wherein the colorant is present to about 60 percent by weight based on the total weight of the developer solids.

9. A developer in accordance with claim 7 wherein the pigment is cyan, magenta, yellow or mixtures thereof.

10. A developer in accordance with claim 7 wherein the pigment is carbon black.

11. A developer in accordance with claim 1 wherein the charge adjuvant is present in an amount of from about 0.1 to about 15 weight percent based on the weight of the developer solids, and there is enabled a negatively charged toner.

12. A developer in accordance with claim 2 wherein component (A) is present in an amount of from about 85 percent to about 99.9 percent by weight, based on the total weight of the liquid developer, the total weight of developer solids is from about 0.1 percent to about 15 percent by weight, and component (C) is present in an amount of from about 0.25 to about 1,500 milligrams/gram developer solids.

13. A developer in accordance with claim 2 wherein component (D) is present in an amount of from about 0.1 to about 15 percent by weight based on the total weight of developer solids.

14. A developer in accordance with claim 2 further containing a second charge adjuvant selected from the group consisting of polyhydroxy compounds which contain at least 2 hydroxy groups, aminoalcohols, polybutylene succinimide and metallic soaps.

15. A developer in accordance with claim 1 wherein the liquid for said developer is an aliphatic hydrocarbon.

16. A developer in accordance with claim 2 wherein the liquid is an aliphatic hydrocarbon.

17. A developer in accordance with claim 15 wherein the aliphatic hydrocarbon is a mixture of branched hydrocarbons of from about 12 to about 16 carbon atoms.

18. A developer in accordance with claim wherein the aliphatic hydrocarbon is a mixture of branched hydrocarbons of from about 12 to about 16 carbon atoms.

19. A developer in accordance with claim 15 wherein the aliphatic hydrocarbon is a mixture of normal hydrocarbons of from about 10 to about 16 carbon atoms.

20. A developer in accordance with claim 16 wherein the aliphatic hydrocarbon is a mixture of normal hydrocarbons of from about 10 to about 16 carbon atoms.

21. A developer in accordance with claim 2 wherein component (C) is an oil-soluble petroleum sulfonate or lecithin.

22. A developer in accordance with claim 2 wherein alkyl contains from 1 to about 25 carbon atoms.

23. A developer in accordance with claim 2 wherein the functional group is methyl, ethyl, butyl, t-butyl, chloro, bromo, or iodo.

24. A developer in accordance with claim 6 wherein the imine bisquinone metal complex is selected from the group consisting of Mg (II) bis[N-(2'-hydroxy-3',5'-di-t-butylphenyl)-4,6-di-t-butyl-o-benzoquinone imine]; Cu (II) bis[N-(2'-hydroxy-3',5'-di-t-butylphenyl)-4,6-di-t-butyl-o-benzoquinone iminate]; Ni (II) bis[N-(2'-hydroxy-3',5'-di-t-butylphenyl)-4,6-di-t-butyl-o-benzoquinone iminate]; Cu (II) bis[N-(2'-hydroxy-3',5'-di-t-butylphenyl)-4,6-di-t-butyl-o-benzoquinone iminate]; Zn (II) bis[N-(2'-hydroxy-3',5'-di-t-butylphenyl)-4,6-di-t-butyl-o-benzoquinone iminate]; Zn (II) bis[N-(2'-hydroxy-3',5'-di-t-butylphenyl)-4,6-di-t-butyl-o-benzoquinone iminate]; Cd (II) bis[N-(2'-hydroxy-3',5'-di-t-butylphenyl)-4,6-di-t-butyl-o-benzoquinone iminate]; Al (III) bis[N-(2'-hydroxy-3',5'-di-t-butylphenyl)-4,6-di-t-butyl-o-benzosemiquinone iminate]; Ga (III) bis[N-(2'-hydroxy-3',5'-di-t-butylphenyl)-4,6-di-t-buyl-o-benzosemiquinone iminate]; In (III) bis[N-(2'-hydroxy-3',5'-di-t-butylphenyl)-4,6-di-t-butyl-o-benzosemiquinone iminate]; Co (III) bis[N-(2'-hydroxy-3',5'-di-t-butylphenyl)-4,6-di-t-butyl-o-benzosemiquinone iminate]; Cr (III) bis[N-(2'-hydroxy-3',5'-di-t-butylphenyl)-4,6-di-t-butyl-o-benzosemiquinone iminate] and mixtures thereof.

25. A developer in accordance with claim 1 wherein the resin is an alkylene polymer, a styrene polymer, an acrylate polymer, a polyester, or mixtures thereof.

26. A developer in accordance with claim 2 wherein the resin is an alkylene polymer, a styrene polymer, an acrylate polymer, a polyester, or mixtures thereof.

27. A developer in accordance with claim 2 wherein the resin is an alkylene polymer, a styrene polymer, an acrylate polymer, a polyester, or mixtures thereof.

28. A developer in accordance with claim 2 wherein component C is a quaternary ammonium block copolymer.

29. An imaging method which comprises forming an electrostatic latent image followed by the development thereof with the liquid developer of claim 1.

30. A liquid developer for use in developing electrostatic images. which developer is comprised of thermoplastic resin particles, a charge director, and a charge adjuvant comprised of an amine bisquinone metal complex, and pigment; and wherein the metal is aluminum or zinc.

* * * * *